US008269704B2

(12) United States Patent
Jung et al.

(10) Patent No.: US 8,269,704 B2
(45) Date of Patent: Sep. 18, 2012

(54) LIQUID CRYSTAL DISPLAY DEVICE AND DRIVING METHOD THEREOF

(75) Inventors: In Yong Jung, Gyeongbuk (KR); Byoung Tae Jung, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 931 days.

(21) Appl. No.: 11/823,614

(22) Filed: Jun. 27, 2007

(65) Prior Publication Data

US 2008/0122768 A1 May 29, 2008

(30) Foreign Application Priority Data

Nov. 23, 2006 (KR) ..... 10-2006-0116176

(51) Int. Cl.
*G09G 3/36* (2006.01)

(52) U.S. Cl. ..... 345/87; 345/90; 345/204; 345/101

(58) Field of Classification Search ..... 345/87, 345/204
See application file for complete search history.

(56) References Cited

U.S. PATENT DOCUMENTS

| | | | | |
|---|---|---|---|---|
| 5,940,055 | A * | 8/1999 | Lee | 345/87 |
| 6,421,038 | B1 * | 7/2002 | Lee | 345/98 |
| 7,098,902 | B2 * | 8/2006 | Tamura | 345/204 |
| 2003/0034965 | A1 * | 2/2003 | Kim | 345/211 |
| 2003/0210239 | A1 * | 11/2003 | Yamazaki | 345/211 |
| 2006/0092109 | A1 * | 5/2006 | Hsu et al. | 345/87 |

* cited by examiner

*Primary Examiner* — Grant Sitta
(74) *Attorney, Agent, or Firm* — Brinks Hofer Gilson & Lione

(57) ABSTRACT

A liquid crystal display device includes a liquid crystal panel having liquid crystal pixels on regions defined by a plurality of gate lines and a plurality data lines, a gate voltage generator configured to generate a gate high voltage and a gate low voltage, and a gate driver configured to generate gate scan signals to respective gate lines using the gate high and low voltages. The gate scan signals are enabled and shifted sequentially by a predetermined interval. A gate voltage modulating unit is configured to modulate the gate high voltage such that an impulse having a negative polarity is added every predetermined period to the gate high voltage supplied to the gate driver. The gate voltage modulating unit controls a width of the impulse depending on characteristics of the liquid crystal panel to control starting points of predetermined edges of the gate scan signals.

6 Claims, 3 Drawing Sheets

LIQUID CRYSTAL DISPLAY DEVICE AND DRIVING METHOD THEREOF

This U.S. non-provisional patent application claims priority under 35 U.S.C. §119 of Korean Patent Application No. 10-2006-0116176, filed on Nov. 23, 2006, the entire contents of which are hereby incorporated by reference.

BACKGROUND

1. Field of the Invention

The present invention relates to a liquid crystal display (LCD) device for displaying an image on a liquid crystal (LC) panel, and more particularly, to an LCD device allowing modulated gate scan signals to be supplied on gate lines of an LC panel, and a driving method thereof.

2. Description of the Related Art

An LCD device controls light transmittance of liquid crystals according to video data so as to display an image corresponding to the video data. The LCD device can provide a large screen size with a slim profile, which is light in weight. LCD devices are used as a display device of a computer or a television receiver, and may substitute for a cathode ray tube (CRT) display device.

To display an image corresponding to video data, an LCD device includes driving circuits for driving an LC panel. The LC panel includes pixels arranged in a matrix. Referring to FIG. 1, each pixel includes a thin film transistor (TFT) MT that responds to a scan signal on a gate line GL to switch a pixel drive signal to be supplied to an LC cell from a data line DL. A voltage charges an LC cell CLC via the TFT MT and initially reaches a voltage level of a pixel drive signal on the data line DL, and then drops by a predetermined voltage ΔVp. Accordingly, the voltage charging the LC cell CLC has a deviation ΔVp from a voltage of the pixel drive signal. This deviation is due to parasitic capacitance in the TFT MT. Consequently, flicker and crosstalk noise are generated on an image displayed on the LC panel.

To prevent effects caused by a difference between the voltage of the pixel drive signal on the data line DL and the voltage charging the LC cell CLC, it has been proposed to slowly modulate a falling edge of a gate scan signal. As illustrated in FIG. 2, a related art LCD device is shown that modulates a gate scan signal, and includes a gate driver 12 for sequentially driving a plurality of gate lines GL1-GLn on an LC panel 10, a data driver 14 for supplying pixel drive voltages to a plurality of data lines DL1-DLm, and a timing controller 16 for controlling the gate driver 12 and the data driver 14.

The gate driver 12 sequentially enables the plurality of gate lines GL1-GLn by a predetermined period (for example, by a period of one horizontal synchronization signal) during one frame. For this purpose, the gate driver 12 generates a plurality of gate scan signals exclusively and respectively having enable pulses that are sequentially shifted every period of a horizontal synchronization signal. Also, the gate driver 12 selectively switches a gate low voltage Vg1 from a gate low voltage generator 20, and a gate high voltage Vgh from a gate high voltage generator 22, to the plurality of gate lines GL1-GLn such that a gate scan signal varies between the gate low voltage Vg1 and the gate high voltage Vgh.

A gate high voltage Vgh is supplied from the gate high voltage generator 22 to the gate deriver 12 and is modulated by a modulating unit 24, such that the gate high voltage Vgh has an impulse of a negative polarity every predetermined period (i.e., the period of a horizontal synchronization signal). The modulating unit 24 includes a modulator 24A connected between the gate high voltage generator 22 and the gate driver 12, a resistor Re connected between the modulator 24A and the gate high voltage generator 22, and a capacitor Ce connected between the resistor Re and an input terminal of the modulator 24A and a ground voltage line GND. The width of an impulse of a negative polarity contained in a modulated gate high voltage signal supplied to the gate driver 12 is determined by a time constant based on the resistance Re and the capacitance Ce.

However, the gate lines GL1-GLn connected to pixels in a line have a deviation in resistance and capacitance depending on the LC panel. The deviation in the resistance and capacitance of the gate lines changes the width of the impulse of the negative polarity contained in the gate high voltage, which causes a deviation ΔVp between a voltage charging an LC cell CLC and a voltage of a pixel drive signal on the data line DL. This deviation is due to an increase of an enable section of a gate high voltage. Accordingly, flicker and crosstalk noise are generated on an image displayed on an LC panel of such related art LCD devices.

SUMMARY

A liquid crystal display device includes a liquid crystal panel having liquid crystal pixels on regions defined by a plurality of gate lines and a plurality data lines, a gate voltage generator configured to generate a gate high voltage and a gate low voltage, and a gate driver configured to generate gate scan signals to respective gate lines using the gate high and low voltages. The gate scan signals are enabled and shifted sequentially by a predetermined interval. A gate voltage modulating unit is configured to modulate the gate high voltage such that an impulse having a negative polarity is added every predetermined period to the gate high voltage supplied to the gate driver. The gate voltage modulating unit controls a width of the impulse depending on characteristics of the liquid crystal panel to control starting points of predetermined edges of the gate scan signals.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
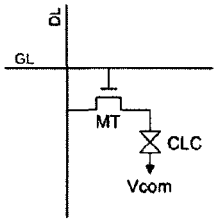
Fig. 1 (Related Art)
FIG. 1 is a circuit diagram explaining pixels on an LC panel.
Figure 2:
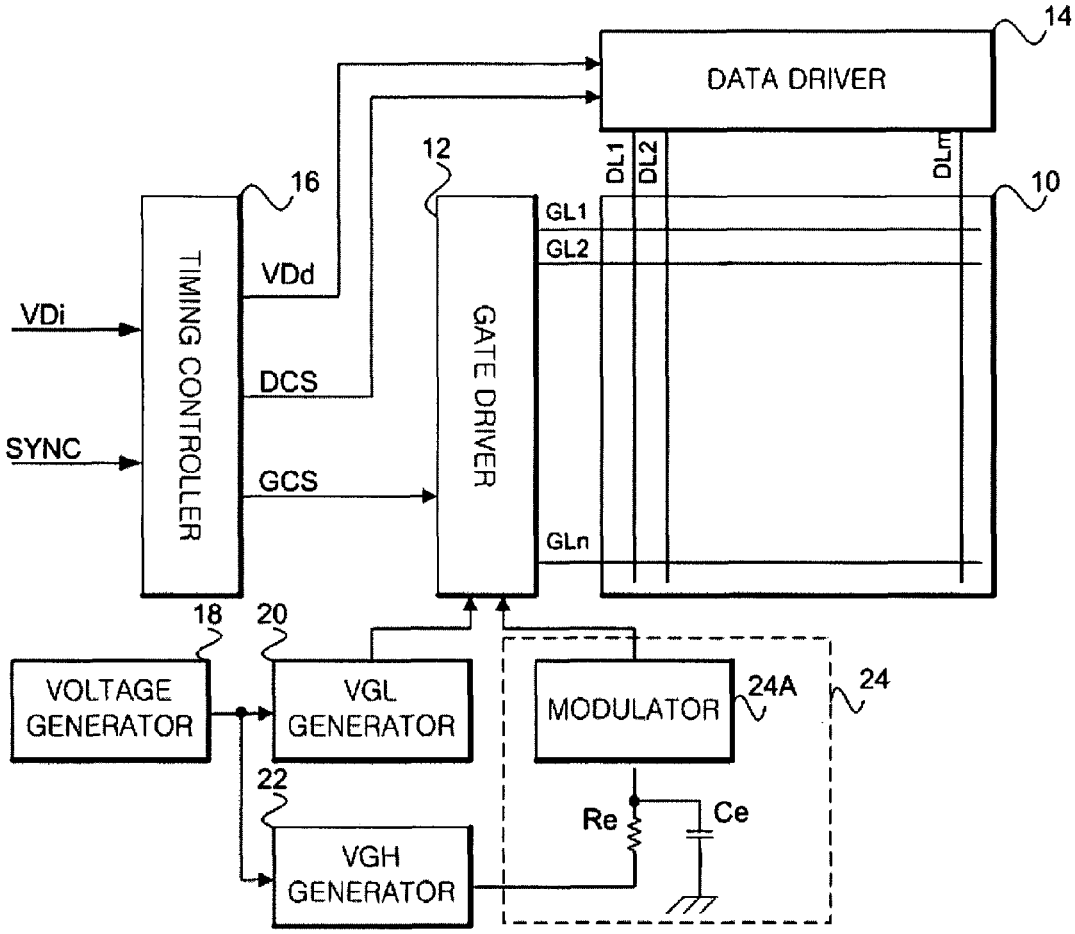
Fig. 2 (Related Art)
FIG. 2 is a schematic block diagram explaining a related art LCD device.
Figure 3:
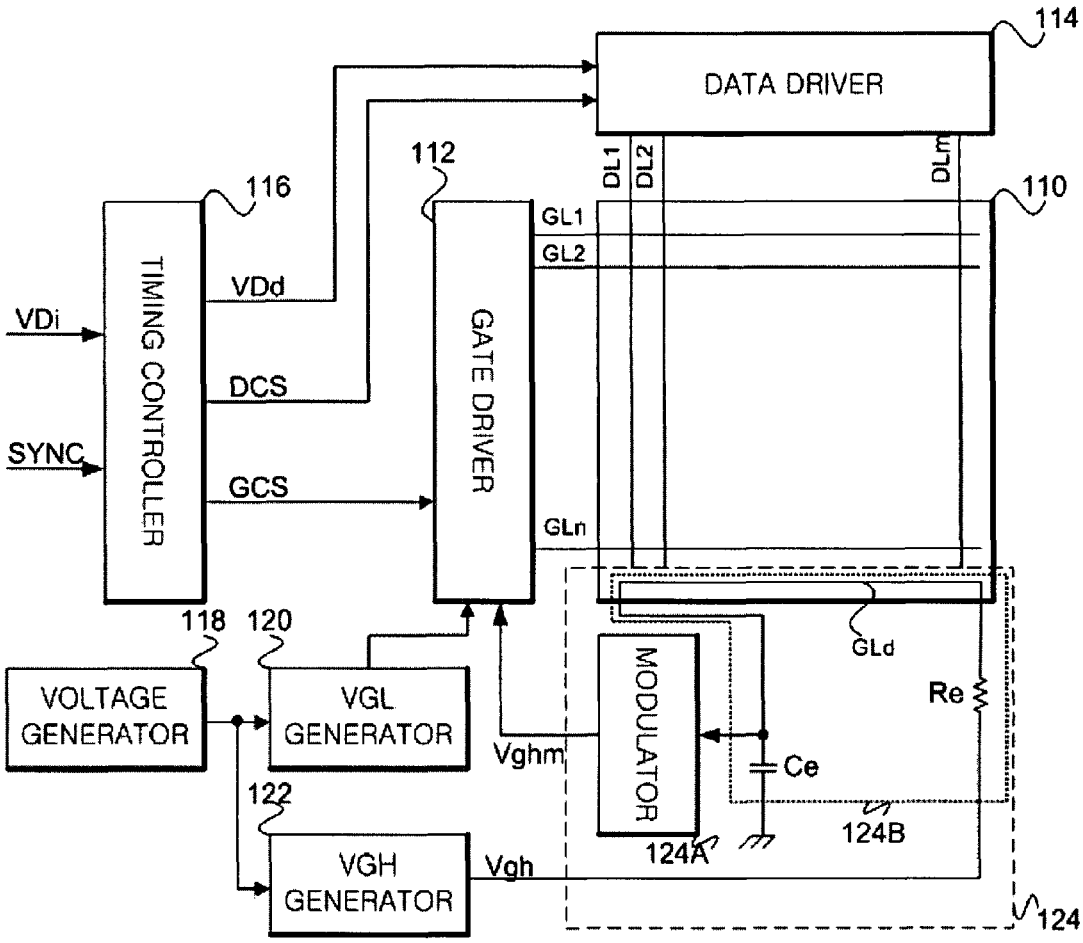
FIG. 3 is a schematic circuit diagram explaining a panel adaptive LCD device according to an embodiment.

FIG. 3 is a schematic circuit diagram explaining a panel adaptive LCD device. The LCD device includes a gate driver 112 connected to a plurality of gate lines GL1-GLn on an LC panel 110, and a data driver 114 connected to a plurality of data lines DL1-DLm on the LC panel 110. The plurality of gate lines GL1-GLn and data liens DL1-DLm are formed on the LC panel 10 and intersect each other to define a plurality of pixel regions. The pixel of FIG. 1 is formed on each of the plurality of pixel regions. Since the construction and operation of each pixel on the LC panel are shown in FIG. 1, details thereof will be omitted.

A dummy gate line GLd is formed in parallel with the gate lines GL1-GLn on the LC panel 110. The dummy gate line GLd has the same length as the gate lines GL1-GLn. Although the dummy gate line GLd is formed next to the last gate line GLn, the dummy gate line GLd can be formed above the first gate line GL1 or between arbitrary adjacent gate lines. Furthermore, a group of dummy pixels (not shown) corresponding to one line may be connected to the dummy gate line GLd. The dummy gate line GLd is used as a sensor for detecting or measuring resistance and capacitance of the gate lines GL1-GLn. Accordingly, the dummy gate line GLd has resistance of several kΩ.

The gate driver 112 sequentially enables the plurality of gate lines GL1-GLn by a predetermined period (e.g., a period of one horizontal synchronization signal) during one frame. For this purpose, the gate driver 112 generates a plurality of gate scan signals having enable pulses that are sequentially shifted every period of a horizontal synchronization signal. A gate enable pulse contained in each of the plurality of gate scan signals has the same width as the period of a horizontal synchronization signal. The gate enable pulse contained in each of the plurality of gate scan signals is generated by one time every frame period. To generate the plurality of gate scan signals, the gate driver 112 responds to gate control signals GCS from the timing controller 116. The gate control signals GCS include a gate start pulse GSP and a gate clock GSC. The gate start pulse GSP has a pulse of a predetermined logic (e.g., a high logic) corresponding to a period of one horizontal synchronization signal from a start point of a frame. The gate clock GSC has the same period as the horizontal synchronization signal.

The data driver 114 generates pixel drive signals corresponding to the number of the data lines DL1-DLm (i.e., the number of pixels arranged on one gate line) when one of the plurality of gate lines GL1-GLn is enabled. Each pixel drive signal contained in a group of pixel drive signals corresponding to one line is supplied to a corresponding pixel (i.e., an LC cell) on the LC panel 110 by way of a corresponding data line DL. Each of pixels arranged on a gate line GL transmits an amount of light corresponding to a voltage level of a pixel drive signal. To generate a group of pixel drive signals corresponding to one line, the data driver 114 sequentially inputs a group of pixel data corresponding to one line every period of an enable pulse contained in a gate scan signal. The data driver 114 converts the sequentially input group of pixel data corresponding to one line, into pixel drive signals at analog levels.

The gate driver 112 and the data driver 114 are controlled by the timing controller 116. The timing controller 116 inputs synchronization signals SYNC from an external video data source (not shown) (e.g., an image signal demodulating unit included in a television receiving module or a graphic card included in a computer system). The synchronization signals SYNC supplied from the external video data source include a data clock Dclk, a horizontal synchronization signal Hsync, and a vertical synchronization signal Vsync and so on. The timing controller 116 generates gate control signals GCS required for the gate driver 112 to generate a plurality of gate scan signals using the synchronization signals SYNC. The plurality of gate scan signals allows the plurality of gate lines GL1-GLn on the LC panel 110 to be sequentially scanned every frame.

Also, the timing controller 116 generates data control signals DCS. The data control signals DCS allow the data driver 114 to sequentially input a group of pixel data corresponding to one line each period that the gate line GL is enabled, and to convert the sequentially input group of pixel data corresponding to one line into pixel drive signals in analog form and output the converted analog signals. Furthermore, the timing controller 116 inputs a pixel data stream Vdi from a video data source divided by a frame unit (an image unit of one sheet). The timing controller 116 divides the pixel data stream Vdi into pixel data streams VDd by an amount of one line, and supplies the divided pixel data streams VDd to the data driver 114.

The LCD device of FIG. 3 includes a gate low voltage generator 120 and a gate high voltage generator 122 connected in common to a voltage generator 118. The gate low voltage generator 120 generates a gate low voltage for shifting a level of a first supply voltage Vcc1 from the voltage generator 118 or a ground voltage GND, to maintain a constant low voltage level. A gate low voltage Vg1 generated by the gate low voltage generator 120 is supplied to the gate driver 112. Similarly, the gate high voltage generator 122 generates a gate high voltage Vgh for shifting a level of a second supply voltage Vcc2 from the voltage generator 118 to maintain a constant and stable high voltage level. The second supply voltage Vcc2 has a high voltage level compared to that of the first supply voltage Vcc1. The gate high voltage Vgh generated by the gate high voltage generator 122 is transmitted to the gate deriver 112.

A modulating unit 124 is connected between the gate high voltage generator 122 and the gate driver 112. The modulating unit 124 allows an impulse of a negative polarity having a slope adaptively varied depending on resistance and capacitance of the gate line GL, to be contained in the gate high voltage Vgh. For this purpose, the modulating unit 124 includes a modulator 124A connected between the gate high voltage generator 122 and the gate driver 112, and a panel adaptive time constant determiner circuit 124B connected between the gate high voltage generator 122 and the modulator 124A. The modulator 124A generates an impulse of a negative polarity every predetermined period, i.e., the period of a horizontal synchronization signal. The modulator 124A adds the generated impulse of a negative polarity to the gate high voltage Vgh to generate a modulated gate high voltage Vghm. The gate high voltage Vghm is supplied to the gate driver 112.

The panel adaptive time constant determiner circuit 124B includes a resistor Re connected between the gate high voltage generator 122 and the modulator 124A, and a capacitor Ce connected between an input terminal of the modulator 124A and a ground voltage line GND. This constitutes a serial circuit, which is in cooperation with the dummy gate line GLd on the LC panel 110.

The width of an impulse of a negative polarity generated at the modulator 124A is determined by parallel-sum of the resistance of the dummy gate line GLd and the resistance of the resistor Re, and the parallel-sum of the capacitance of the dummy gate line GLd and the capacitance of the capacitor Ce. The resistance and capacitance of the dummy gate line GLd can increase or decrease depending on the LC panel 110. Accordingly, the parallel-sum of the resistance of the dummy gate line GLd and the resistance of the resistor Re, and the parallel-sum of the capacitance of the dummy gate line GLd and the capacitance of the capacitor Ce can increase or decrease.

Consequently, a time constant determined by the above-described parallel-sums of resistance and capacitance can increase or decrease depending on the LC panel 110 (i.e., resistance and capacitance of the dummy gate line GLd). Since the time constant is increased or decreased by the panel adaptive time constant determiner circuit 124B, the width of an impulse having a negative polarity added to a gate high voltage Vgh by the modulator 124A is adaptively increased or decreased (GHMn, GHMi, and GHMd shown in FIG. 4) to be inversely proportional to the LC panel 110. In other words, an enable section of a modulated gate high voltage GHM output from the modulator 124A is adaptively increased or decreased in proportion to the resistance and the capacitance of the dummy gate line GLd.

Figure 4:
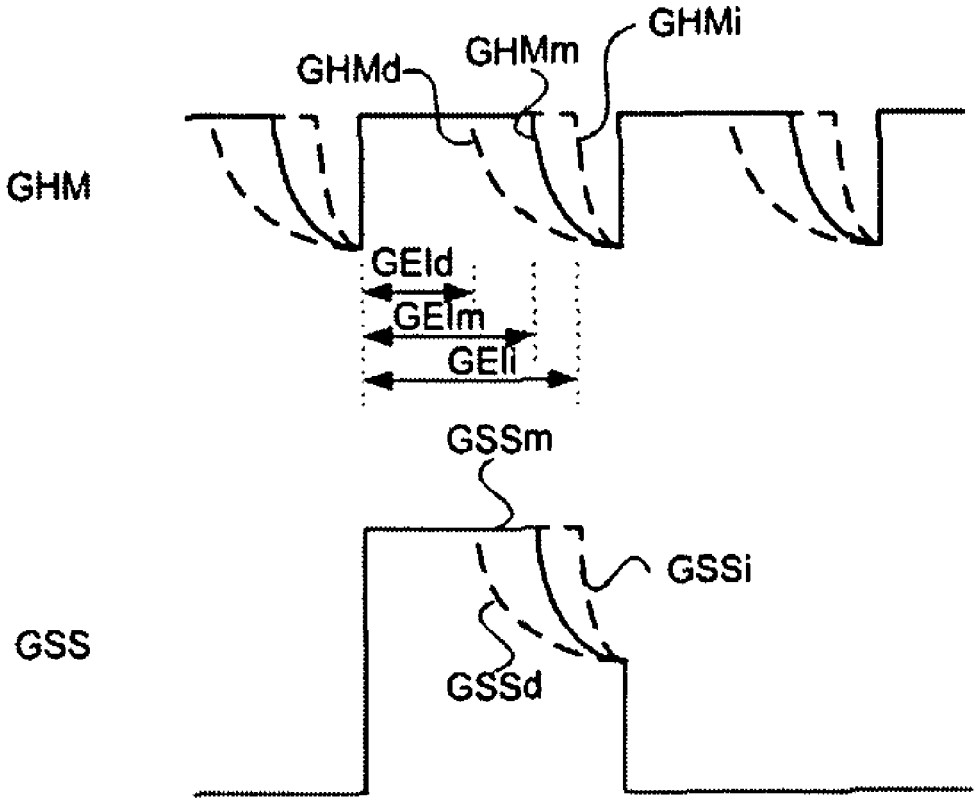
FIG. 4 is a signal diagram for the modulator and the gate driver shown in FIG. 3.

For example, when the resistance and capacitance of the dummy gate line GLd that changes depending on the LC panel 110 have an average value (or resistance and capacitance designed by a manufacturer), the enable section of the modulated gate high voltage GHM has a length of GEIm at GHMm, shown in FIG. 4. For this purpose, the resistor Re is set to a resistance of several kΩ. In this case, when the resistance and capacitance of the dummy gate line GLd are greater than average values, the enable section of the modulated gate high voltage GHM output from the modulator 124A increases as GEIi at GHMi of FIG. 4. When the resistance and capacitance of the dummy gate line GLd are smaller than average values, the enable section of the modulated gate high voltage GHM output from the modulator 124A decreases as GEId at GHMd, as shown in FIG. 4.

A starting point of a falling edge of gate scan signals GSS sequentially supplied to the gate lines GL1-GLn becomes fast or slow as shown in FIG. 4 by the modulated gate high voltage Vghm. For example, when a modulated gate high voltage GHM, such as GHMm, is generated (that is, when resistance and capacitance of the gate line GL have an average value), a gate scan signal GSS reduces from a point after a period corresponding to an intermediate enable section GEIm elapses after the gate scan signal GSS is enabled to a gate high voltage Vgh.

Accordingly, a deviation ΔVp between a voltage charging an LC cell CLC and a voltage of a pixel drive signal on a data line DL is minimized. When a modulated gate voltage GHM, such as GHMi, is generated (that is, when resistance and capacitance of the gate line GL are greater than an average value), a gate scan signal GSS reduces from a delayed point after a period corresponding to an enable section GEIi longer than the intermediate enable section GEIm elapses after the gate scan signal GSS is enabled to a gate high voltage Vgh. Accordingly, a deviation ΔVp between a voltage charging an LC cell CLC and a voltage of a pixel drive signal on a data line DL, is minimized. This is because an amount (or time) of charging of the LC cell CLC increases.

When a modulated gate voltage GHM, such as GHMd, is generated (that is, when resistance and capacitance of the gate line GL are smaller than an average value), a gate scan signal GSS reduces from a fast point after a period corresponding to an enable section GEId shorter than the intermediate enable section GEIm elapses after the gate scan signal GSS is enabled to a gate high voltage Vgh. Accordingly, a deviation ΔVp between a voltage charged to an LC cell CLC and a voltage of a pixel drive signal on a data line DL, is minimized. This is because an amount (or time) of charging of the LC cell CLC decreases.

A gate high voltage having an impulse of a negative polarity is modulated to have a width that adaptively changes in an inverse proportion to resistance and capacitance of the gate line GL on the LC panel 110. The modulated gate high voltage allows a starting point of a falling edge of a gate scan signal supplied to a gate line to be delayed or precede an increase in an amount (or time) of charging of the LC cell CLC. Accordingly, a deviation ΔVp between a voltage charging an LC cell CLC and a voltage of a pixel drive signal on a data line DL is minimized. Consequently, flicker and crosstalk noise are not generated. As described above, a gate high voltage having an impulse of a negative polarity is modulated to have a width that adaptively changes in inverse proportion to the resistance and capacitance of a gate line GL on an LC panel.

It will be apparent to those skilled in the art that various modifications and variations can be made in the present invention. Thus, it is intended that the present invention covers the modifications and variations of this invention provided they come within the scope of the appended claims and their equivalents. For example, the panel adaptive time constant determiner 124B can additionally include a second resistor connected in parallel to the dummy gate line GLd. In this case, a change width of the sum of the capacitance and resistance determining a time constant can be controlled to be smaller than a change width of the capacitance and resistance of a dummy gate line. Accordingly, a change width of a point at a falling edge of a gate scan signal can be also finely controlled. Alternatively, the panel adaptive time constant determiner 124B can include a resistor connected as a parallel circuit with the dummy gate line GLd instead of a resistor Re series-connected to the dummy gate line GLd. In this case, resistance of the parallel-connected resistor is set to be greater than a resistance of the dummy gate line GLd.

What is claimed is:

1. A liquid crystal display device comprising:

a liquid crystal panel including liquid crystal pixels on regions defined by a plurality of gate lines and a plurality data lines;

a gate voltage generator that generates a gate high voltage and a gate low voltage required to driving the gate lines;

a gate driver that supplies gate scan signals to the gate lines, respectively, using the gate high and low voltages from the gate voltage generator, the gate scan signals enabled and shifted sequentially by a predetermined interval; and a gate voltage modulating unit that modulates the gate high voltage such that an impulse having a negative polarity is added every predetermined period to the gate high voltage to be supplied to the gate driver from the gate voltage generator, and controls a width of the impulse depending on the liquid crystal panel such that start points of predetermined edges of the gate scan signals are controlled, wherein the liquid crystal panel further includes a dummy gate line formed in parallel with the plurality of gate lines, the dummy gate line is formed next to the last gate line or above the first gate line or between arbitrary adjacent gate lines, wherein the gate voltage modulating unit comprises a modulator connected between the gate voltage generator and the gate driver to modulate a gate high voltage such that the impulse of the negative polarity is added to the gate high voltage and a time constant determiner connected between the gate voltage generator, the modulator, and the liquid crystal panel to change the width of the impulse having the negative polarity in response to at least one of resistance and capacitance of a portion of the liquid crystal panel, wherein the time constant determiner comprises a capacitor connected to an input terminal of the modulator and a resistor constituting a serial circuit connected between the gate voltage generator and the input terminal of the modulator in cooperation with the dummy gate line, wherein an one side of the dummy gate line is connected to the capacitor and the other side of the dummy gate line is connected to the resistor, wherein the dummy gate line, the capacitor and the resistor constitute the serial circuit, wherein a width of the impulse of the negative polarity generated at the modulator is determined by a series-sum of the resistance of the dummy gate line and the resistance of the resistor, and a series-sum of the capacitance of the dummy gate line and the capacitance of the capacitor, wherein an enable section of the modulated gate high voltage from the modulator is adaptively increased or decreased in proportion to the resistance and the capacitance of the dummy gate line.

2. The liquid crystal display device according to claim 1, wherein the time constant determiner changes the width of the impulse having the negative polarity in response to at least one of resistance and capacitance of the gate line on the liquid crystal panel.

3. The liquid crystal display device according to claim 1, wherein the time constant determiner narrows the width of the impulse having the negative polarity when resistance and capacitance of the dummy gate line are high, and widens the width of the impulse having the negative polarity when resistance and capacitance of the dummy gate line are low.

4. A method for driving a liquid crystal display device, the method comprising:

detecting at least one of resistance and capacitance of a portion of a liquid crystal panel by a time constant determiner having a resistor and a capacitor ;

determining a width of an impulse having a negative polarity to be added to a gate high voltage using at least one of the detected resistance and capacitance;

modulating the gate high voltage such that the impulse having the negative polarity and the determined width is added every predetermined period to the gate high voltage to be supplied to a gate driver from a gate voltage generator; and controlling start points of predetermined edges of gate scan signals to be supplied to gate lines on the liquid crystal panel using the gate high voltage to which the impulse having the negative polarity has been added, wherein the detecting of the at least one of resistance and capacitance comprises detecting at least one of resistance and capacitance of a dummy gate line on the liquid crystal panel, the dummy gate line is formed next to the last gate line or above the first gate line or between arbitrary adjacent gate lines, wherein an one side of the dummy gate line is connected to the capacitor and the other side of the dummy gate line is connected to the resistor, wherein the dummy gate line, the capacitor and the resistor constitute the serial circuit, wherein a width of the impulse of the negative polarity generated at the modulator is determined by parallel a series-sum of the resistance of the dummy gate line and the resistance of the resistor, and the parallel a series-sum of the capacitance of the dummy gate line and the capacitance of the capacitor, wherein an enable section of the modulated gate high voltage from the modulator is adaptively increased or decreased in proportion to the resistance and the capacitance of the dummy gate line.

5. The method according to claim 4, wherein the detecting of the at least one of resistance and capacitance comprises responding to a signal from a serial circuit including the dummy gate line.

6. The method according to claim 5, wherein the determining of the width of the impulse comprises: narrowing the width of the impulse having the negative polarity when at least one of resistance and capacitance of the dummy gate line is high, and widening the width of the impulse having the negative polarity when the at least one of resistance and capacitance of the dummy gate line is low.

* * * * *